United States Patent [19]

Delatte

[11] Patent Number: 4,665,713

[45] Date of Patent: May 19, 1987

[54] DEVICE FOR STORING TUBES IN A CRYOGENIC CONTAINER

[75] Inventor: Daniel Delatte, Saint-Maur, France

[73] Assignee: L'Air Liquide, Societe Anonyme pour l'Etude et l'Exploitation des Procedes George Claude, Paris, France

[21] Appl. No.: 840,955

[22] Filed: Mar. 17, 1986

[30] Foreign Application Priority Data

Mar. 26, 1985 [FR] France ..... 85 04458

[51] Int. Cl.[4] ..... F25D 3/12

[52] U.S. Cl. ..... 62/382; 62/457

[58] Field of Search ..... 62/78, 60, 457, 382, 62/514 R; 220/21

[56] References Cited

U.S. PATENT DOCUMENTS

| | | | |
|---|---|---|---|
| 1,665,681 | 4/1928 | Telling | 206/558 |
| 3,113,689 | 12/1963 | Moussong | 217/17 |
| 3,151,760 | 10/1964 | Cowley et al. | 62/457 |
| 3,184,071 | 5/1965 | Delaire | 211/74 |
| 3,306,689 | 2/1967 | Isaacson et al. | 312/199 |
| 3,362,577 | 1/1968 | Singer et al. | 220/104 |
| 3,379,315 | 4/1968 | Broadwin | 211/72 |
| 3,593,873 | 7/1971 | Vonk | 220/21 |
| 3,744,665 | 7/1973 | Spoto | 220/21 |
| 3,940,249 | 2/1976 | McClurg | 62/457 |
| 3,952,536 | 4/1976 | Faust et al. | 62/457 |
| 4,113,329 | 9/1978 | Thurman | 312/111 |
| 4,143,764 | 3/1979 | Moss, III | 206/429 |
| 4,328,676 | 5/1982 | Reed | 62/457 |
| 4,377,077 | 3/1983 | Granlnd | 62/78 |

FOREIGN PATENT DOCUMENTS

| | | |
|---|---|---|
| 2528152 | 1/1977 | Fed. Rep. of Germany . |
| 2819678 | 11/1979 | Fed. Rep. of Germany . |
| 1242025 | 8/1960 | France . |
| 2461216 | 1/1981 | France . |

*Primary Examiner*—Ronald C. Capossela

*Attorney, Agent, or Firm*—Young & Thompson

[57] ABSTRACT

Each module (1) of this device comprises a bin (4), two removable drawers (5) and a removable intermediate partition (7). When the two drawers are in position, tubes (2) of small height can be stored. When the upper drawer and the partition (7) are withdrawn, tubes (3) of greater height can be stored. Each drawer is provided with a grating (6) for laterally maintaining the tubes. Application in the storage of biological specimens in liquid nitrogen.

9 Claims, 3 Drawing Figures

DEVICE FOR STORING TUBES IN A CRYOGENIC CONTAINER

The present invention relates to a device for storing in a cryogenic container tubes having different heights, this device being of the type comprising superimposed removable drawers slidably mounted in a frame. It more particularly applies to the storage of biological products in liquid nitrogen.

Tubes intended for the cryogenic storage of biological products such as animal or human semen normally have a standard diameter but different heights corresponding to 2 ml and 5 ml specimens. Consequently, there must at present be provided two types of storing devices, namely one for each type of tubes.

An object of the invention is to provide a storing device offering great flexibility owing to the possibility of simultaneously storing both types of tubes in variable proportions.

The invention therefore provides a storing device of the aforementioned type, wherein the frame comprises at least one module comprising a bin adapted to receive at least two drawers and a removable intermediate horizontal partition adapted to be disposed in the bin between the drawers.

Preferably, for ensuring a good maintenance of the tubes in position, each drawer is provided at an intermediate height with a tube-positioning grating, this grating comprising, for each tube, an opening through which the tube can freely pass, and projections surrounding the opening for laterally maintaining the tube. It is then advantageous to arrange that the grating be capable of being removed and turned over.

An embodiment of the invention will now be described with reference to the accompanying drawing, in which.

Figure 1:
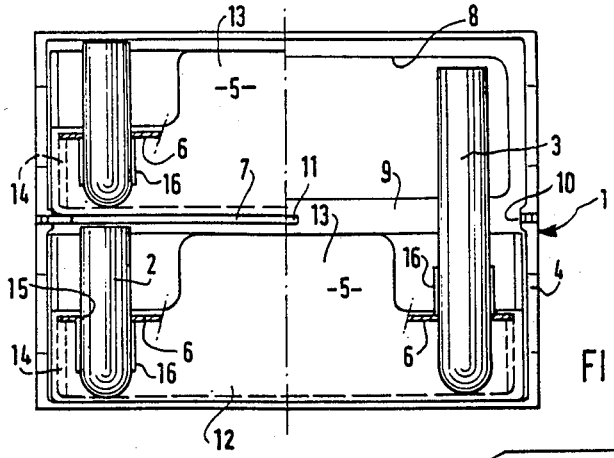
FIG. 1 is a front elevational view, with parts cut away and partly in section, of a module of a storing device according to the invention, illustrated in two different configurations of utilization.

The storing module 1 shown in the drawing is adapted to maintain in position a number of tubes 2,3 for the preservation of biological products in a container (not shown) filled with liquid nitrogen. In practice, a plurality of modules 1 are stacked and fixed to each other, for example by welding or clipping means, so as to occupy the entire height of the container, the upper module being provided with a handle. Further, although the illustrated module 1 has a rectangular shape in plan, it may also have some other shape, for example a triangular shape, so that the assembly of the stacks of modules occupies the available space in the container in the best way.

Figure 2:
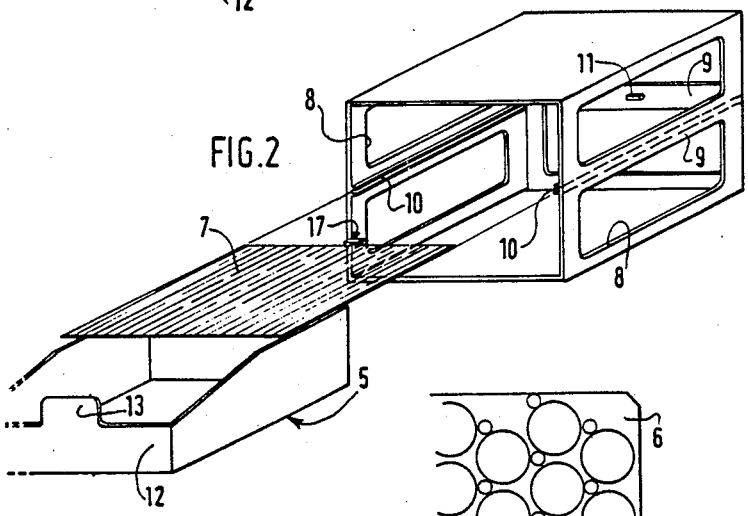
FIG. 2 is a partial exploded perspective view of the module of FIG. 1.

The module 1 comprises a bin 4, two drawers 5 each provided with a grating 6 (the upper drawer and the grating 6 are not shown in FIG. 2 in order to render the drawing more clear), and a partition 7. All these elements are made from a plastics material adapted to withstand the cryogenic temperatures.

The tubes 2 and 3 have a common diameter, but the tubes 3 have a height which is roughly double that of the tubes 2. They are intended to preserve 2 ml specimens (tubes 2) and 5 ml specimens (tubes 3) respectively.

The bin 4 is parallel-sided and open on its front side. Its upper and lower sides are solid and its other three sides are well apertured by pairs of window 8 separated by horizontal members 9 located midway up the height of the bin. Each lateral member includes an inner groove 10 and the rear member includes a clipping cavity 11.

Each drawer 5 is upwardly open. Its front side 12, of reduced height, has a median gripping strip 13. On its inner periphery, the drawer has a number of vertical ribs 14 which extend roughly up to mid-height. Further, although this has not been shown, the drawer includes in its bottom at least one liquid nitrogen emptying opening and also outer clipping projections for maintaining it in position in the bin.

Figure 3:
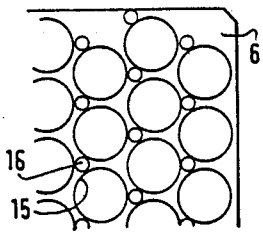
FIG. 3 is a partial plan view of a tube-positioning grating.

Associated with each drawer is a grating 6 whose corner is shown in FIG. 3. This grating has a large number of circular openings 15 whose diameter is slightly larger than that of the tubes 2 and 3 and, between these openings, a large number of cylindrical pins 16 disposed in such manner that each opening is surrounded by three pins 16. The height of each pin is slightly less than one half of the height of a drawer. The partition 7 is a rectangular plate whose lateral edges are adapted to slide in the grooves 10 of the bin and whose rear edge defines a projection 17 for clipping into the cavity 11.

In a first manner of using the module 1 illustrated in the left half of FIG. 1, 2 ml tubes 2 are stored. Placed in the ribs 14 of each of the two drawers is the corresponding grating 6, with the pins 16 extending downwardly. The tubes 2 are placed in the openings 15. Thus each tube 2 is maintained in a vertical position and can be easily taken hold of by its upper part for extraction.

The partition 7 is placed in position, the lower drawer is inserted under the partition and bears against the lower bottom of the bin 4, and the upper drawer 5 is inserted above the partition and bears against the latter. The height of the tubes is such that each one bears against the bottom of the corresponding drawer and extends up to a level slightly below the wall disposed thereabove, namely the partition 7 for the lower tubes 2 and the upper wall of the bin 4 for the upper tubes 2.

When the assembly of the modules 1 is immersed in liquid nitrogen, the tubes 2 have a tendency to float on this liquid and therefore to rise. They are retained vertically, some by the partition 7 and the others by the upper wall of the bin, and laterally by the pins 16 (which, by way of a modification, could be replaced by cylindrical collars). It can be seen that it is possible to pull out either of the drawers 5, without disturbing the positioning of the tubes 2 of the other drawer, owing to the double function of the partition 7, namely both supporting the upper drawer and vertically retaining the lower tubes.

Another manner of using the module 1 for storing 5 ml tubes 3 is illustrated in the right half of FIG. 1. The upper drawer is withdrawn and the grating 6 of the lower drawer bears against the ribs 14 of the latter, but, this time, with the pins 16 extending upwardly. The long tubes 3 are disposed in the openings 15 and extend from the bottom of the lower drawer up to a position in the neighbourhood of the upper wall of the bin 4. More precisely, the distance between this wall and the upper ends of the tubes 3 is distinctly less than that between the bottom of the drawer and the top of the pins 16.

When the module is immersed in the liquid nitrogen, the tubes 3 have a tendency to float on this liquid and therefore to rise, but they are retained vertically by the upper wall of the bin 4 and guided laterally by the pins 16. Thus, here again, the arrangement of the tubes is not disturbed.

Thus it can be seen that there is provided a very flexible storing device permitting the preservation of tubes of different lengths. With a set of different gratings, these tubes could also have different diameters. By way of a modification, each module could have three drawers and two intermediate partitions so as to still more increase the possibilities of utilization.

What is claimed is:

1. A device for storing tubes of different heights in a cryogenic container, said device comprising: a bin comprising a bottom wall, two opposite side walls extending upwardly from said bottom wall, there being an open side between said walls; at least one removable partition adapted to be horizontally disposed in the bin and supported by a pair of horizontal partition-supporting means confronting each other on said opposite side walls; and at least two drawers adapted to be inserted in the bin through said open side, one of said drawers lying above the other of said drawers such that the lower of said drawers is supported by said bottom wall and the upper of said drawers is supported by said partition.

2. A device according to claim 1, further comprising a tube-positioning grating located at an intermediate height of each said drawer, the grating comprising a plurality of openings through which each tube can freely pass and projections surrounding each opening for laterally maintaining each tube.

3. A device according to claim 2, wherein three said projections surround each said opening.

4. A device according to claim 2, wherein said grating is invertible and said projection surrounding said openings extend on only one side of said grating.

5. A device according to claim 2, wherein a third wall extends between said two side walls and is opposite said open side, each of said walls containing at least two windows, one of said windows being located above said horizontal partition supporting means and the other of said windows being located below said horizontal partition supporting means.

6. A device as in claim 5, wherein said horizontal partition supporting means comprise grooves on each of said two side walls.

7. A device as in claim 2, wherein each said drawer has at its inner periphery a number of vertical ribs which extend up to about mid-height of the drawer.

8. A device according to claim 1, further comprising means on each device for attaching it to a similar device so that the devices may be stored one on top of the other, an uppermost device being provided with a handle.

9. A device according to claim 2, further comprising means on each device for attaching it to a similar device so that the devices may be stored one on top of the other, an uppermost device being provided with a handle.

* * * * *